US011858090B2

(12) United States Patent
Sekiya

(10) Patent No.: US 11,858,090 B2
(45) Date of Patent: Jan. 2, 2024

(54) GRINDING APPARATUS AND METHOD OF DRIVING GRINDING APPARATUS

(71) Applicant: DISCO CORPORATION, Tokyo (JP)

(72) Inventor: Kazuma Sekiya, TOkyo (JP)

(73) Assignee: DISCO CORPORATION, Tokyo (JP)

( * ) Notice: Subject to any disclaimer, the term of this patent is extended or adjusted under 35 U.S.C. 154(b) by 46 days.

(21) Appl. No.: 17/455,989

(22) Filed: Nov. 22, 2021

(65) Prior Publication Data

US 2022/0193861 A1 Jun. 23, 2022

(30) Foreign Application Priority Data

Dec. 21, 2020 (JP) ..... 2020-211013

(51) Int. Cl.
*B24B 49/02* (2006.01)
*B24B 49/12* (2006.01)

(52) U.S. Cl.
CPC ..... *B24B 49/02* (2013.01); *B24B 49/12* (2013.01)

(58) Field of Classification Search
CPC ..... B24B 49/02; B24B 49/12; B24B 49/00; B24B 49/03–06; B24B 49/04; B24B 49/045; B24B 49/10; B24B 27/0076; B24B 27/0069; B24B 1/00; B24B 7/228; B24B 41/005; B24B 41/02; B24B 51/00; B24B 37/345; B24B 37/34
USPC ..... 451/5
See application file for complete search history.

(56) References Cited

U.S. PATENT DOCUMENTS

2005/0072528 A1* 4/2005 Owczarz ..... B24B 57/02 156/345.16
2017/0066103 A1* 3/2017 Tomioka ..... B24B 37/20
2017/0176331 A1* 6/2017 Ryo ..... H01L 21/67253
2018/0102268 A1* 4/2018 Sekiya ..... H01L 21/67766

FOREIGN PATENT DOCUMENTS

CN 108500826 A * 9/2018
JP 2007288031 A 11/2007
JP 2007305628 A * 11/2007
JP 2013158880 A * 8/2013

* cited by examiner

*Primary Examiner* — Joel D Crandall
*Assistant Examiner* — Michael A Gump
(74) *Attorney, Agent, or Firm* — Greer Burns & Crain Ltd.

(57) ABSTRACT

After a workpiece unit has been delivered from a cassette and before the workpiece unit is delivered to a chuck table, a value of the thickness of the workpiece unit is recognized on the basis of a result of a measurement performed by a measuring unit. The value of the thickness of the workpiece unit is represented by the sum of values of respective thicknesses of a workpiece and a tape affixed thereto. On the basis of the result of the measurement performed by the measuring unit, it is possible to decide whether or not the tape affixed to the workpiece has a desired thickness, i.e., whether the tape is of a desired type or not. As a result, a workpiece with an inadequate tape affixed thereto is prevented from being ground.

12 Claims, 8 Drawing Sheets

GRINDING APPARATUS AND METHOD OF DRIVING GRINDING APPARATUS

BACKGROUND OF THE INVENTION

Field of the Invention

The present invention relates to a grinding apparatus and a method of driving a grinding apparatus.

Description of the Related Art

Chips containing devices such as integrated circuits (ICs) and LSI (large scale integration) circuits are components indispensable in various electronic appliances including mobile phones, personal computers, etc. Such chips are manufactured by thinning a wafer with a number of devices formed in respective areas on a face surface thereof and then separating the areas of the wafer into individual pieces as device chips.

One method of thinning a wafer is grinding performed by a grinding apparatus that includes a grinding wheel having a plurality of grindstones arranged discretely in an annular array and a chuck table for holding a workpiece, i.e., the wafer, under suction thereon. When a wafer is to be ground by the grinding apparatus, it is often customary to affix a tape, i.e., a protective tape, to the face surface of the wafer before the wafer is ground (see, for example, JP2007-288031A).

The wafer is thinned when the grindstones grind a side of a reverse surface of the wafer while a side of the face surface of the wafer with the tape affixed thereto is being held under suction on the chuck table. The tape affixed to the face surface of the wafer on which the devices have been formed is effective to soften shocks that are applied to the devices when the wafer is ground, thereby preventing the devices from being damaged.

SUMMARY OF THE INVENTION

Tapes for use on workpieces such as wafers are available in various types having different thicknesses, bonding strengths, and so on. Different types of tapes to be affixed to those workpieces are used under different grinding conditions. When the grinding apparatus is in operation, a workpiece with a desired tape affixed thereto, referred to in its entirety as a workpiece unit, is delivered from a cassette that houses such workpiece units to the chuck table where the workpiece will be ground.

A tape is affixed to a workpiece using a dedicating tape affixing apparatus. When a tape as a consumable item in the tape affixing apparatus is to be replaced or replenished with a new one, it is the usual practice for an operator to do so manually. Therefore, an inappropriate tape may possibly be set in the tape affixing apparatus and affixed to a workpiece due to an operator's oversight.

In addition, workpiece units may manually be introduced into cassettes and cassettes that house workpiece units may manually be introduced into the grinding apparatus by the operator. Consequently, cassettes that house workpieces with inadequate tapes affixed thereto may possibly be introduced into the grinding apparatus.

Furthermore, tapes of different types are frequently similar to each other in terms of color and sense of touch. As a result, it is difficult for the operator to confirm the type of a tape affixed to a workpiece by seeing or touching the tape before the workpiece is ground on the grinding apparatus.

In view of the above drawbacks, it is an object of the present invention to provide a grinding apparatus that is capable of preventing a workpiece with an inadequate tape affixed thereto from being ground, and a method of driving such a grinding apparatus.

In accordance with an aspect of the present invention, there is provided a grinding apparatus including a cassette rest base for placing thereon a cassette for housing a workpiece unit that includes a workpiece and a tape affixed to a surface of the workpiece, a chuck table for holding the workpiece unit thereon, a delivery mechanism for delivering the workpiece unit between the cassette and the chuck table, a first measuring unit for measuring a value of a thickness of the workpiece unit held by the delivery mechanism or a value to be used to calculate the value of the thickness of the workpiece unit held by the delivery mechanism, a grinding unit for grinding the workpiece unit held on the chuck table, and a control unit for controlling the chuck table, the delivery mechanism, the first measuring unit, and the grinding unit. The control unit includes a deciding section for deciding whether the workpiece unit is a target to be ground or not depending on the value of the thickness of the workpiece unit that is obtained from a result of the measurement performed by the first measuring unit on the workpiece unit after the workpiece unit has been delivered from the cassette and before the workpiece unit is delivered to the chuck table.

Preferably, according to the above aspect of the invention, the control unit should include a storage section for storing values of respective thicknesses of the workpiece and the tape, in which the deciding section decides whether a desired tape has been affixed to the workpiece or not by comparing a sum of the values of the thicknesses, stored in the storage section, of the workpiece and the tape and the value of the thickness of the workpiece unit that is obtained from the result of the measurement performed by the first measuring unit with each other.

Preferably, according to the above aspect of the invention, the first measuring unit should include a first non-contact-type distance measuring device disposed on a side of one surface of the workpiece unit held by the delivery mechanism, for measuring a distance up to the one surface of the workpiece unit, and a second non-contact-type distance measuring device disposed on a side of another surface that is a reverse surface opposite the one surface of the workpiece unit held by the delivery mechanism, for measuring a distance up to the other surface of the workpiece unit.

Preferably, according to the above aspect of the invention, the grinding apparatus should further include a second measuring unit for measuring a value of the thickness of the workpiece unit held on the chuck table or a value to be used to calculate the value of the thickness of the workpiece unit held on the chuck table, in which the deciding section decides whether the second measuring unit is operating normally or not by comparing the value of the thickness of the workpiece unit that is obtained from a result of the measurement performed by the second measuring unit and the value of the thickness of the workpiece unit that is obtained from the result of the measurement performed by the first measuring unit with each other.

In accordance with another aspect of the present invention, there is provided a method of driving a grinding apparatus including a cassette rest base for placing thereon a cassette for housing a workpiece unit that includes a workpiece and a tape affixed to a surface of the workpiece, a chuck table for holding the workpiece unit thereon, a delivery mechanism for delivering the workpiece unit between the cassette and the chuck table, a first measuring unit for measuring a value of a thickness of the workpiece unit held by the delivery mechanism or a value to be used to calculate the value of the thickness of the workpiece unit held by the delivery mechanism, a grinding unit for grinding the workpiece unit held on the chuck table, and a control unit for controlling the chuck table, the delivery mechanism, the first measuring unit, and the grinding unit. The method includes a first unloading step in which the delivery mechanism delivers the workpiece unit from the cassette placed on the cassette rest base, a first measuring step in which the first measuring unit measures a value of the thickness of the workpiece unit held by the delivery mechanism or a value to be used to calculate the value of the thickness of the workpiece unit held by the delivery mechanism, a first deciding step in which the control unit decides whether the workpiece unit is a target to be ground or not depending on the value of the thickness of the workpiece unit that is obtained from a result of the measurement performed in the first measuring step, and a loading step in which, if the control unit determines in the first deciding step that the workpiece unit is a target to be ground, then the delivery mechanism delivers the workpiece unit to the chuck table, and if the control unit determines in the first deciding step that the workpiece unit is not a target to be ground, then the delivery mechanism delivers the workpiece unit back into the cassette.

Preferably, the workpiece unit is raised above a height of the chuck table when the value measured by the first measuring unit is obtained.

Preferably, according to the other aspect of the present invention, the grinding apparatus should further include a second measuring unit for measuring a value of the thickness of the workpiece unit held on the chuck table or a value to be used to calculate the value of the thickness of the workpiece unit held on the chuck table, in which the method further includes a grinding step in which the grinding unit grinds the workpiece unit delivered to the chuck table in the loading step, a second measuring step in which the second measuring unit measures a value of the thickness of the workpiece unit ground in the grinding step or a value to be used to calculate the value of the thickness of the workpiece unit ground in the grinding step, a second unloading step in which the delivery mechanism delivers the workpiece unit whose value of the thickness has been measured in the second measuring step from the chuck table, a third measuring step in which the first measuring unit measures a value of the thickness of the workpiece unit delivered from the chuck table in the second unloading step or a value to be used to calculate the value of the thickness of the workpiece unit delivered from the chuck table in the second unloading step, and a second deciding step in which the control unit decides whether the second measuring unit is operating normally or not by comparing the value of the thickness of the workpiece unit that is obtained from a result of the measurement performed in the second measuring step and the value of the thickness of the workpiece unit that is obtained from a result of the measurement performed in the third measuring step with each other.

Preferably, alternatively, according to the other aspect of the present invention, the grinding apparatus should further include a second measuring unit for measuring a value of the thickness of the workpiece unit held on the chuck table or a value to be used to calculate the value of the thickness of the workpiece unit held on the chuck table, in which the method further includes a fourth measuring step in which the second measuring unit measures a value of the thickness of the workpiece unit before the workpiece unit delivered to the chuck table in the loading step is ground or a value to be used to calculate the value of the thickness of the workpiece unit before the workpiece unit delivered to the chuck table in the loading step is ground, and a third deciding step in which the control unit decides whether the second measuring unit is operating normally or not by comparing the value of the thickness of the workpiece unit that is obtained from a result of the measurement performed in the fourth measuring step and the value of the thickness of the workpiece unit that is obtained from a result of the measurement performed in the first measuring step with each other.

According to the present invention, after a workpiece unit has been delivered from the cassette and before the workpiece unit is delivered to the chuck table, a value of the thickness of the workpiece unit is recognized on the basis of a result of the measurement performed by the first measuring unit. The value of the thickness of the workpiece unit is represented by the sum of values of the respective thicknesses of the workpiece and the tape affixed thereto.

On the basis of the result of the measurement performed by the first measuring unit, it is possible to decide whether the tape affixed to the workpiece has a desired thickness or not, i.e., whether the tape is of a desired type or not. Stated otherwise, it is possible to decide whether the workpiece unit is a target to be ground or not before the workpiece unit is delivered to the chuck table. As a result, a workpiece with an inadequate tape affixed thereto is prevented from being ground.

The above and other objects, features and advantages of the present invention and the manner of realizing them will become more apparent, and the invention itself will best be understood from a study of the following description and appended claims with reference to the attached drawings showing a preferred embodiment of the invention.

DETAILED DESCRIPTION OF THE PREFERRED EMBODIMENT

Figure 1:
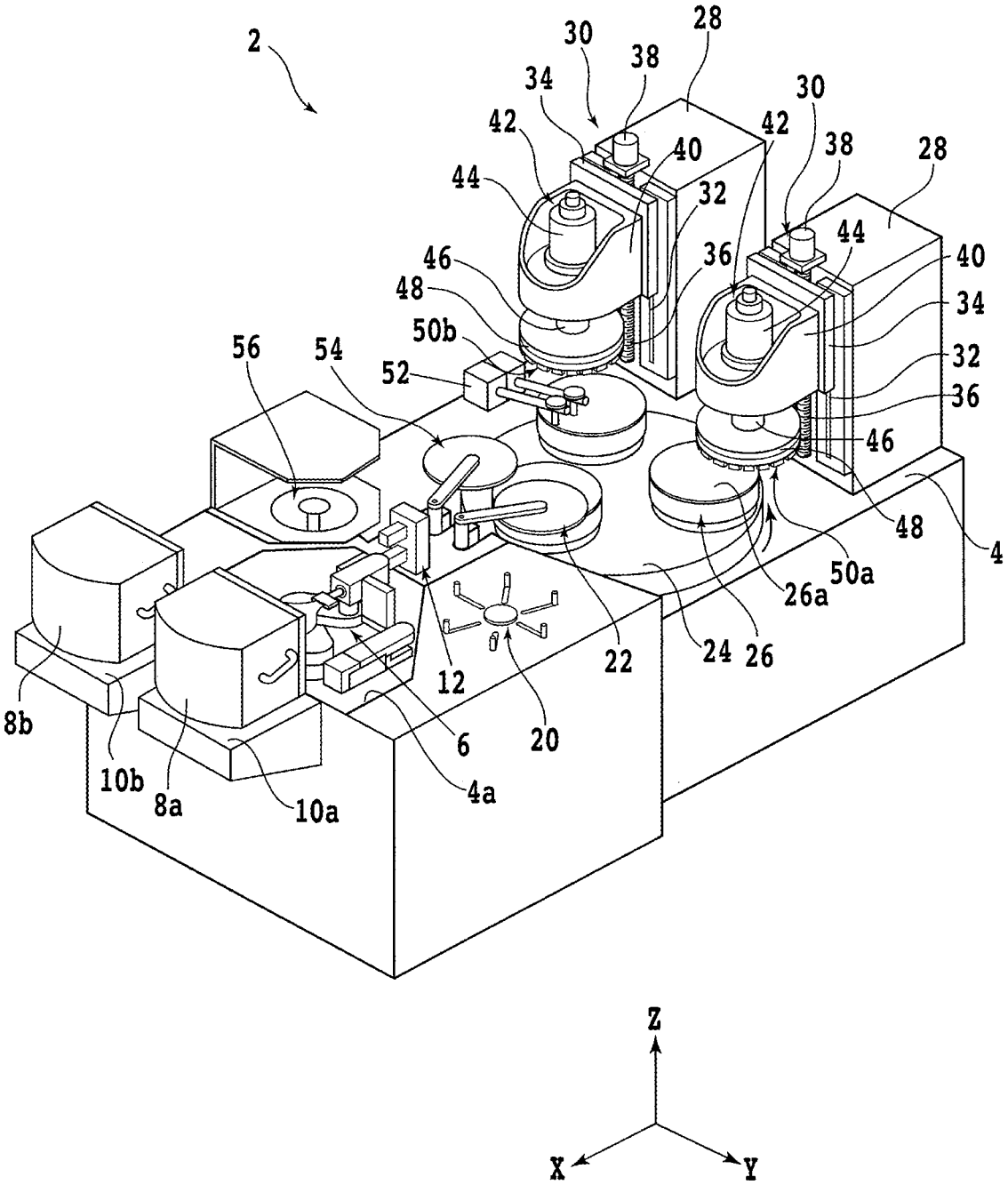
FIG. 1 is a perspective view schematically illustrating by way of example a grinding apparatus according to an embodiment of the present invention.

A preferred embodiment of the present invention will be described in detail below with reference to the accompanying drawings. FIG. 1 schematically illustrates in perspective by way of example a grinding apparatus according to the embodiment of the present invention. In FIG. 1, X-axis directions (forward and rearward directions) and Y-axis directions (leftward and rightward directions) represent respective directions that extend perpendicularly to each other in a horizontal plane, and Z-axis directions (upward and downward directions) represent directions perpendicular to the X-axis directions and the Y-axis directions, i.e., vertical directions.

Figure 2:
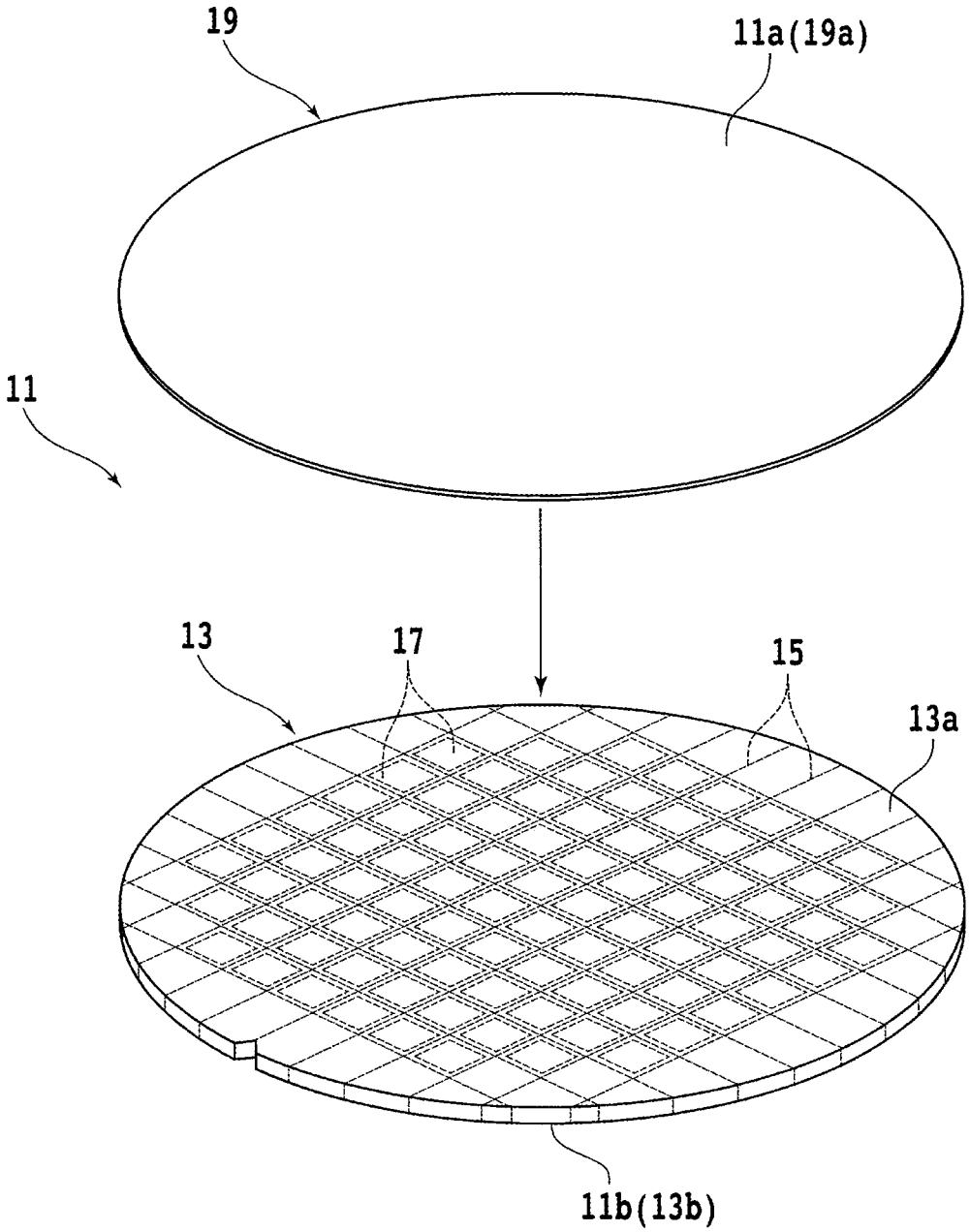
FIG. 2 is a perspective view schematically illustrating a workpiece unit by way of example.

The grinding apparatus, denoted by 2 in FIG. 1, includes a base 4 supporting thereon various components thereof. The base 4 has an opening 4*a* defined in a front end of an upper surface thereof and housing a delivery mechanism 6 therein. The delivery mechanism 6 is, for example, a robot arm having a plurality of joints. FIG. 2 schematically illustrates in perspective by way of example a workpiece unit that is delivered by the delivery mechanism 6.

The workpiece unit 11 illustrated in FIG. 2 has a disk-shaped workpiece 13. The workpiece 13 is, for example, a wafer made of a semiconductor material such as silicon (Si). The workpiece 13 has a side of a face surface 13*a* including a plurality of areas demarcated by a plurality of intersecting projecting dicing lines 15, with devices 17 such as ISs or LSI circuits formed in the respective areas.

The workpiece 13 is not limited to any particular materials, shapes, structures, sizes, etc. The workpiece 13 may be made of materials including other semiconductor materials, ceramic, resin, metal, etc. Similarly, the devices 17 are not limited to any particular kinds, quantities, shapes, structures, sizes, layouts, etc.

The workpiece unit 11 also has a film-like tape 19 that is affixed to the face surface 13*a* of the workpiece 13 and generally equal in diameter to the workpiece 13. The tape 19 is made of resin, for example, and protects the devices 17 by softening shocks that are applied to the side of the face surface 13*a* when a side of a reverse surface 13*b* of the workpiece 13 is ground.

According to the present embodiment, while a side of one surface 11*a* of the workpiece unit 11, i.e., a surface 19*a* of the tape 19 that is not affixed to the workpiece 13, is being held in position, a side of another surface 11*b* of the workpiece unit 11, i.e., the reverse surface 13*b* of the workpiece 13, is ground.

As illustrated in FIG. 1, two cassette rest bases 10*a* and 10*b* for placing respective cassettes 8*a* and 8*b* that house workpiece units 11 therein are mounted on the front end of the base 4 forwardly of the opening 4*a*. The delivery mechanism 6 is able to not only hold and deliver the workpiece unit 11 but also turn the workpiece unit 11 upside down.

Figure 3:
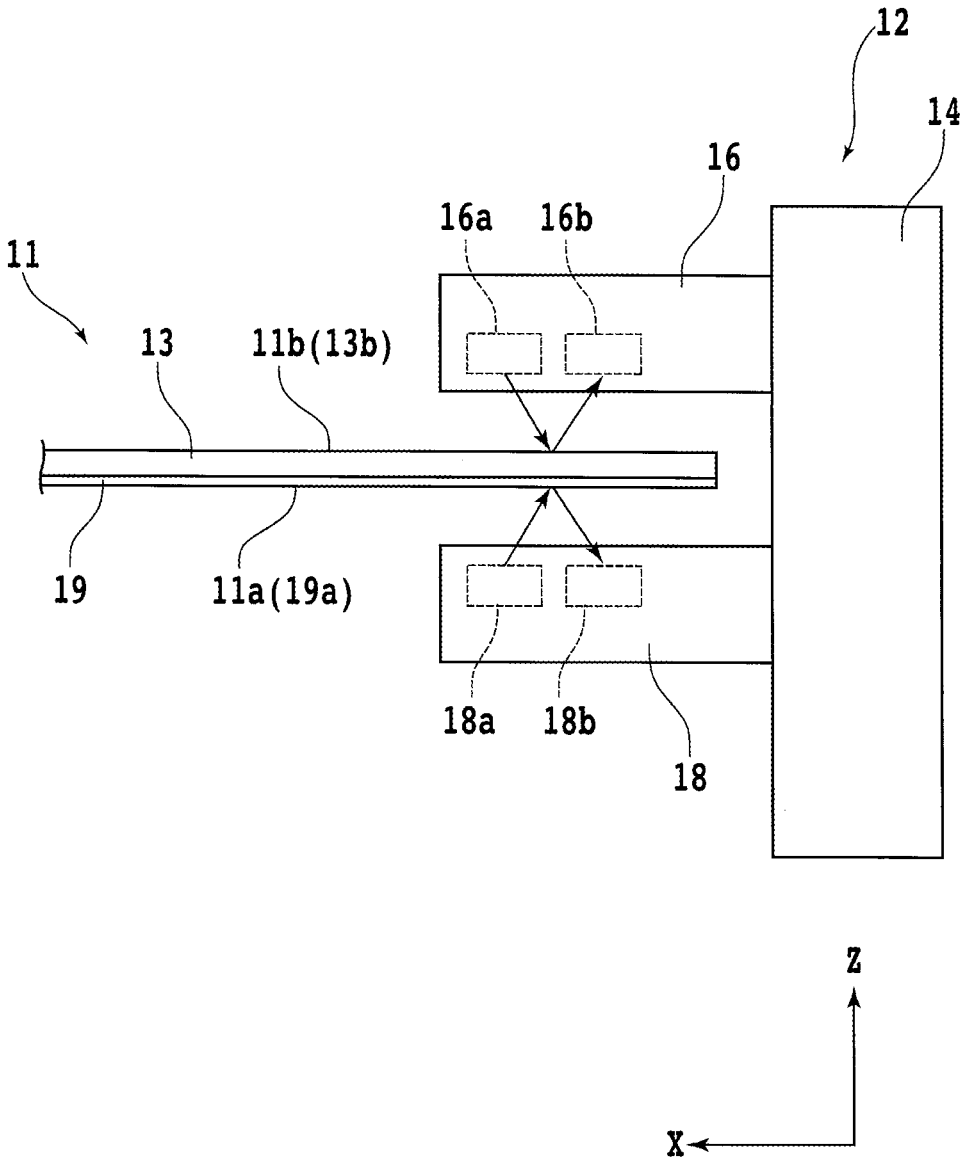
FIG. 3 is a side elevational view schematically illustrating a measuring unit of the grinding apparatus by way of example.

A measuring unit, i.e., a first measuring unit, 12 that is used to calculate a value of the thickness of the workpiece unit 11 held by the delivery mechanism 6 is mounted on the base 4 behind the opening 4*a*. FIG. 3 schematically illustrates the measuring unit 12 in side elevation.

As illustrated in FIG. 3, the measuring unit 12 includes a support 14 shaped as a quadrangular prism extending along the Z-axis directions and an upper surface measuring device 16 and a lower surface measuring device 18 that are fixed to a front surface of the support 14 that faces the delivery mechanism 6 and each shaped as a quadrangular prism extending along the X-axis directions. The upper surface measuring device 16 and the lower surface measuring device 18 are spaced from each other along the Z-axis directions. Each of the upper surface measuring device 16 and the lower surface measuring device 18 is a non-contact-type distance measuring device for measuring the distance up to a measurand, i.e., an object to be measured, using a laser beam.

Specifically, the upper surface measuring device 16 includes a light emitter 16*a* for emitting a laser beam downwardly toward the upper surface of a measurand, e.g., the other surface 11*b* of the workpiece unit 11, and a light detector 16*b* for detecting a laser beam reflected from the upper surface of the measurand, e.g., the other surface 11*b* of the workpiece unit 11. The upper surface measuring device 16 measures the distance up to the upper surface of the measurand on the basis of a phase difference or the like between the emitted laser beam and the reflected laser beam.

Similarly, the lower surface measuring device 18 includes a light emitter 18*a* for emitting a laser beam upwardly toward the lower surface of a measurand, e.g., the one surface 11*a* of the workpiece unit 11, and a light detector 18*b* for detecting a laser beam reflected from the upper surface of the measurand, e.g., the one surface 11*a* of the workpiece unit 11. The lower surface measuring device 18 measures the distance up to the lower surface of the measurand on the basis of a phase difference or the like between the emitted laser beam and the reflected laser beam.

The light emitter 16*a* includes, for example, a light source for emitting light having a wavelength reflected by the upper surface of the measurand, e.g., the reverse surface 13*b* of the workpiece 13 and a lens and/or a mirror for guiding the emitted light from the light source to the measurand. Similarly, the light emitter 18*a* includes, for example, a light source for emitting light having a wavelength reflected by the lower surface of the measurand, e.g., the surface 19*a* of the tape 19 and a lens and/or a mirror for guiding the emitted light from the light source to the measurand.

The wavelength of the light emitted from the light emitter 16*a* and the wavelength of the light emitted from the light emitter 18*a* may be different from each other. Each of the light detectors 16*b* and 18*b* includes, for example, a lens and/or a mirror for guiding the light reflected from the measurand and a light detecting element such as a complementary metal oxide semiconductor (CMOS) image sensor for detecting the reflected light guided by the lens and/or the mirror.

As illustrated in FIG. 1, the grinding apparatus 2 also includes a position adjusting mechanism 20 mounted on the base 4 obliquely behind the opening 4*a*, i.e., sideways of the measuring unit 12, for adjusting the position of the workpiece unit 11 delivered by the delivery mechanism 6. The position adjusting mechanism 20 includes, for example, a disk-shaped table and a plurality of pins radially movably disposed around the table.

The position adjusting mechanism 20 operates in the following manner. When the workpiece unit 11 is delivered from the cassette 8*a* and placed on the table of the position adjusting mechanism 20 by the delivery mechanism 6, the pins are moved radially inwardly into contact with an outer circumferential edge of the workpiece unit 11, aligning the center of the workpiece unit 11 with a predetermined position in the X-axis directions and the Y-axis directions. According to the present embodiment, the workpiece unit 11 is placed on the table of the position adjusting mechanism 20 such that the reverse surface 11*b* faces upwardly.

According to the present embodiment, furthermore, the workpiece unit 11 that is delivered from the cassette 8*a* by the delivery mechanism 6 is introduced into the position adjusting mechanism 20 after an outer circumferential portion of the workpiece unit 11 is positioned between the upper surface measuring device 16 and the lower surface measuring device 18 of the measuring unit 12 and a value of the thickness of the workpiece unit 11 is calculated.

A delivery mechanism 22 for holding the workpiece unit 11 picked up from the position adjusting mechanism 20 and delivering the workpiece unit 11 rearwardly is mounted on the base 4 behind the measuring unit 12. The delivery mechanism 22 includes a holding pad for holding the side of the upper surface of the workpiece unit 11, i.e., the reverse surface 11*b* thereof according to the present embodiment, under suction, and an arm connected to the holding pad. The delivery mechanism 22 delivers the workpiece unit 11 that has been adjusted in position by the position adjusting mechanism 20 backwardly by turning the holding pad with the arm.

A disk-shaped turntable 24 is mounted on the base 4 behind the delivery mechanism 22. The turntable 24 is connected to a rotary actuator, not illustrated, such as an electric motor and is rotatable thereby about a rotational axis extending generally parallel to the Z-axis directions. The turntable 24 supports on its upper surface three chuck tables 26 for holding respective workpiece units 11 thereon.

The chuck tables 26 are spaced apart by generally equal angular intervals along circumferential directions of the turntable 24. Though the turntable 24 supports the three chuck tables 26 thereon according to the present embodiment, the number, etc. of chuck tables 26 supported on the turntable 24 is not limited according to the present invention.

Figure 4:
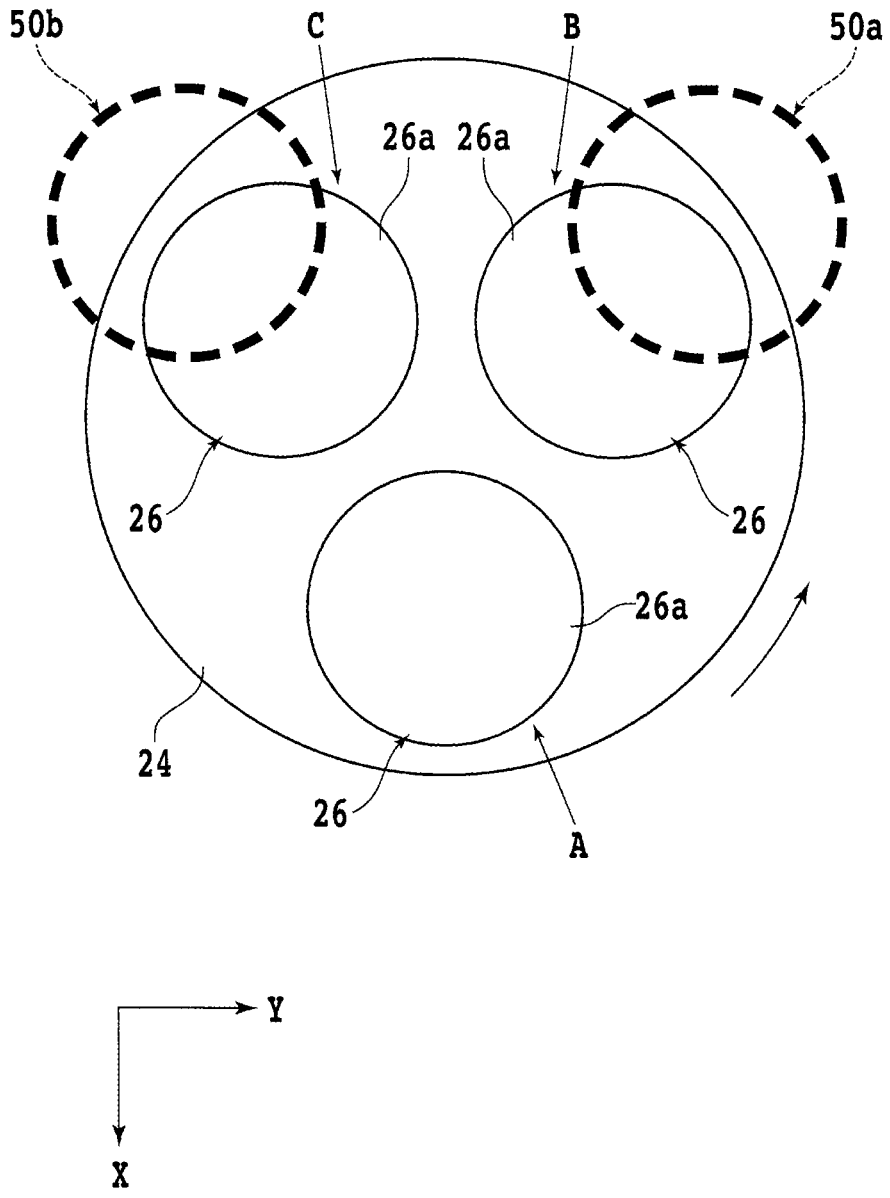
FIG. 4 is a plan view schematically illustrating a turntable and peripheral structures of the turntable by way of example.

FIG. 4 schematically illustrates in plan the turntable 24 and peripheral structures of the turntable 24 by way of example. In FIG. 4, some components are indicated by broken lines for illustrative purposes. The delivery mechanism 22 turns the arm to deliver the workpiece unit 11 held by the holding pad to one of the chuck tables 26 that is located in a loading/unloading area A (see FIG. 4) adjacent to the delivery mechanism 22.

The turntable 24 is rotated in a direction indicated by an arrow in FIGS. 1 and 4 to move each of the chuck tables 26 successively to the loading/unloading area A, a rough grinding area B, and a finish grinding area C. Each of the chuck tables 26 is connected to a rotary actuator, not illustrated, such as an electric motor and is rotatable thereby about a rotational axis extending generally parallel to the Z-axis directions.

Each of the chuck tables 26 has a disk-shaped frame body made of a metal material such as stainless steel. The frame body has a recess defined in an upper surface thereof and having a circular opening in its upper end. A disk-shaped porous plate made of ceramic or the like is fixedly mounted in the recess.

Each of the chuck tables 26 has an upper surface provided by the porous plate and shaped as a conical surface having its center protruding slightly upwardly beyond its outer edge. The conical upper surface functions as a holding surface 26*a* for holding thereon the side of the lower surface of the workpiece unit 11, i.e., the face surface 11*a* thereof according to the present embodiment. In other words, each of the chuck tables 26 has in its upper portion the holding surface 26*a* for holding the workpiece unit 11 thereon.

The holding surface 26*a* is connected to a suction source, not illustrated, such as a vacuum pump through a suction channel, not illustrated, defined in the chuck table 26. The workpiece unit 11 that has been placed on the chuck table 26 has its lower surface attracted to the holding surface 26*a* by a negative pressure generated and applied to the holding surface 26*a* by the vacuum source.

As illustrated in FIG. 1, two columnar support structures 28 are mounted on the base 4 behind the rough grinding area B and the finish grinding area C, respectively, i.e., behind the turntable 24. A Z-axis moving mechanism 30 is mounted on a front surface of each of the columnar support structures 28. The Z-axis moving mechanism 30 includes a pair of guide rails 32 lying generally parallel to each other and extending along the Z-axis directions, and a movable plate 34 slidably mounted on the guide rails 32.

A nut, not illustrated, of a ball screw is fixed to a rear surface, i.e., a reverse surface, of the movable plate 34, and the screw shaft 36 that is extending generally parallel to the guide rails 32 is rotatably threaded through the nut. The screw shaft 36 has an end coupled to an electric motor 38. When the electric motor 38 is energized, it rotates the screw shaft 36, causing the nut to move the movable plate 34 in the Z-axis directions along the guide rails 32.

A spindle housing mount 40 is disposed on a front surface, i.e., a face surface, of each of the movable plates 34. The spindle housing mount 40 supports thereon a grinding unit 42 for grinding the workpiece unit 11. The grinding unit 42 includes a spindle housing 44 fixed to the spindle housing mount 40.

The spindle housing 44 houses a spindle 46 rotatably disposed therein that is rotatable about a rotational axis extending generally parallel to the Z-axis directions. The spindle 46 has a lower end portion exposed downwardly from a lower end face of the spindle housing 44. A disk-shaped grinding wheel mount 48 is fixed to the exposed lower end portion of the spindle 46.

The grinding unit 42 on the support structure 28 disposed behind the rough grinding area B includes a first grinding wheel 50*a* for rough grinding that is mounted on a lower surface of the grinding wheel mount 48. The first grinding wheel 50*a* for rough grinding includes a first wheel base made of metal such as stainless steel or aluminum and having generally the same diameter as the grinding wheel mount 48.

The first wheel base has a lower surface on which there are disposed a plurality of first grindstones arranged in an annular array that are made of abrasive grains of diamond or the like suitable for rough grinding that are bound together by a vitrified or resinoid bond. The spindle housing 44 of the grinding unit 42 behind the rough grinding area B houses therein a first rotary actuator, not illustrated, such as an electric motor that is connected to an upper end of the spindle 46.

When the first rotary actuator is energized, it rotates the spindle 46 and hence the first grinding wheel 50*a* about their rotational axes that are aligned with each other along the Z-axis directions. Near the first grinding wheel 50*a*, there is positioned a grinding liquid supply nozzle, not illustrated, for supplying liquid, i.e., grinding liquid, such as pure water to a region, i.e., a processing point, where the workpiece unit 11 to be ground and the first grindstones are held in contact with each other. The grinding liquid supply nozzle may be replaced or combined with grinding liquid supply ports defined in the first grinding wheel 50*a* for supplying liquid.

Similarly, the grinding unit 42 on the support structure 28 disposed behind the finish grinding area C includes a second grinding wheel 50*b* for finish grinding that is mounted on a lower surface of the grinding wheel mount 48. The second grinding wheel 50*b* for finish grinding includes a second wheel base made of metal such as stainless steel or aluminum and having generally the same diameter as the grinding wheel mount 48.

The second wheel base has a lower surface on which there are disposed a plurality of second grindstones arranged in an annular array that are made of abrasive grains of diamond or the like suitable for finish grinding that are bound together by a vitrified or resinoid bond. The spindle housing 44 of the grinding unit 42 behind the finish grinding area C houses therein a second rotary actuator, not illustrated, such as an electric motor that is connected to an upper end of the spindle 46.

When the second rotary actuator is energized, it rotates the spindle 46 and hence the second grinding wheel 50*b* about their rotational axes that are aligned with each other along the Z-axis directions. Near the second grinding wheel 50*b*, there is positioned a grinding liquid supply nozzle, not illustrated, for supplying liquid, i.e., grinding liquid, such as pure water to a region, i.e., a processing point, where the workpiece unit 11 to be ground and the second grindstones are held in contact with each other. The grinding liquid supply nozzle may be replaced or combined with grinding liquid supply ports defined in the second grinding wheel 50*b* for supplying liquid.

Workpiece units 11 that are held on the respective chuck tables 26 are successively ground by the two grinding units 42 described above. Specifically, the workpiece unit 11 held on the chuck table 26 that has moved to the rough grinding area B is ground by the grinding unit 42 positioned near the rough grinding area B, whereas the workpiece unit 11 held on the chuck table 26 that has moved to the finish grinding area C is ground by the grinding unit 42 positioned near the finish grinding area C.

As illustrated in FIG. 1, a measuring unit, i.e., a second measuring unit, 52 that is used to calculate a value of the thickness of the workpiece unit 11 that has been finish-ground by the grinding unit 42 is disposed forwardly of the grinding unit 42 that is positioned near the finish grinding area C.

The measuring unit 52 has a first measuring section whose tip end is capable of contacting an upper surface of a measurand, i.e., the reverse surface 11*b* of the workpiece unit 11 according to the present embodiment, and a second measuring section whose tip end is capable of contacting the holding surface 26*a* of the chuck table 26. The first measuring section and the second measuring section each include a contact-type position (height) measuring device for measuring the position or height of the tip end thereof in vertical directions. Stated otherwise, the second measuring unit 52 includes two contact-type position (height) measuring devices.

A delivery mechanism 54 for holding the workpiece unit 11 that has been ground and delivering the workpiece unit 11 forwardly is mounted on the base 4 forwardly of the loading/unloading area A and sideways of the delivery mechanism 22. The delivery mechanism 54 includes a holding pad for holding the side of the upper surface of the workpiece unit 11, i.e., the reverse surface 11*b* thereof according to the present embodiment, under suction, and an arm connected to the holding pad. The delivery mechanism 54 delivers the workpiece unit 11 that has been ground forwardly from the chuck table 26 by turning the holding pad with the arm.

A cleaning unit 56 for cleaning the workpiece unit 11 delivered by the delivery mechanism 54 is disposed in front of the delivery mechanism 54. The cleaning unit 56 includes, for example, a spinner table rotatable while holding thereon the side of the lower surface of the workpiece unit 11, i.e., the face surface 11*a* thereof according to the present embodiment, and a nozzle for ejecting a cleaning fluid to the side of the upper surface of the workpiece unit 11, i.e., the reverse surface 11*b* thereof according to the present embodiment, held on the spinner table.

The workpiece unit 11 that has been cleaned by the cleaning unit 56 is delivered by the delivery mechanism 6. For example, the workpiece unit 11 is delivered from the cleaning unit 56 into the cassette 8*b* by the delivery mechanism 6 after an outer circumferential portion of the workpiece unit 11 has been positioned between the upper surface measuring device 16 and the lower surface measuring device 18 of the measuring unit 12 and a value of the thickness of the workpiece unit 11 has been calculated. Alternatively, the workpiece unit 11 may be delivered from the cleaning unit 56 directly into the cassette 8*b* by the delivery mechanism 6.

In addition, the grinding apparatus 2 may include other components than those described above. For example, the grinding apparatus 2 may include a touch panel having a touch sensor for entering instructions from an operator into the grinding apparatus 2 and a display for outputting various pieces of information for the operator to see.

Figure 5:
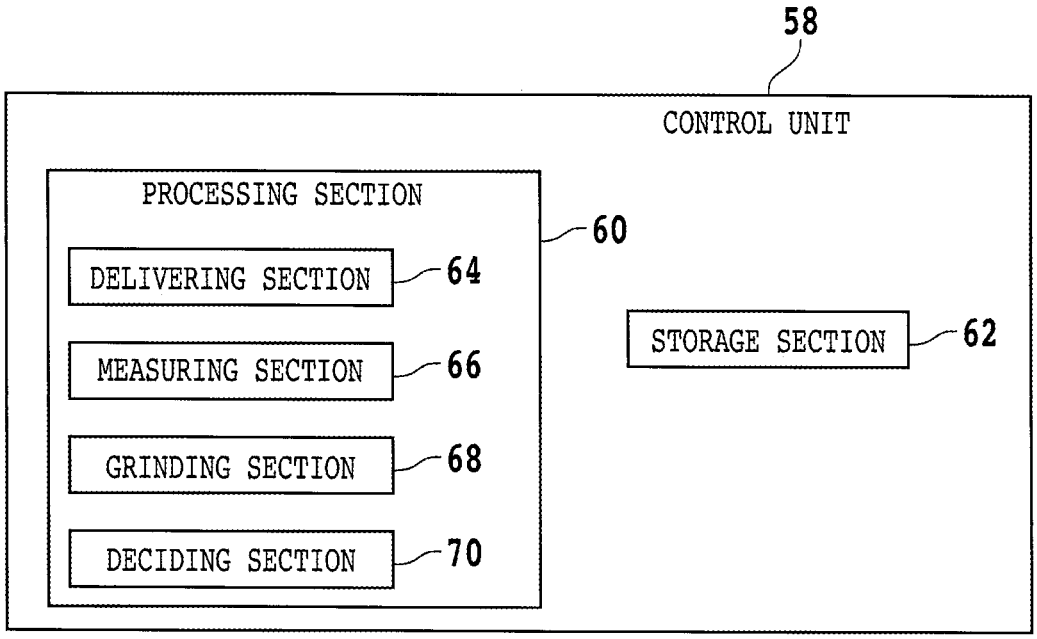
FIG. 5 is a block diagram schematically illustrating a control unit of the grinding apparatus by way of example.

Operation of the components of the grinding apparatus 2 is controlled by a control unit included in the grinding apparatus 2. FIG. 5 schematically illustrates in block form the control unit, denoted by 58, included in the grinding apparatus 2 by way of example. As illustrated in FIG. 5, the control unit 58 includes, for example, a processing section 60 for generating signals for controlling the components of the grinding apparatus 2 and a storage section 62 for storing various pieces of information, such as data and programs, for use in the processing section 60.

For instance, the storage section 62 stores, in advance, values of the thicknesses of workpieces 13 and tapes 19 of workpiece units 11 as targets to be ground by the grinding apparatus 2 and a value of an interval between the upper surface measuring device 16 and the lower surface measuring device 18 of the measuring unit 12.

The processing section 60 has functions performed by a central processing unit (CPU) or the like that reads and executes programs stored in the storage section 62. The storage section 62 has functions performed by at least one of semiconductor memories such as a dynamic random access memory (DRAM), a static random access memory (SRAM), and a NAND-type flash memory and a magnetic storage device such as a hard disk drive (HDD).

The processing section 60 includes a delivering section 64, a measuring section 66, a grinding section 68, and a deciding section 70 as functional sections. These functional sections perform independent processing sequences at different times or simultaneously. The processing section 60 may have other functional sections than the delivering section 64, the measuring section 66, the grinding section 68, and the deciding section 70. For example, the processing section 60 may have a displaying section for controlling displaying operation of the display that is a component of the touch panel.

The delivering section 64 controls operation of the delivery mechanism 6, the delivery mechanism 22, and the delivery mechanism 54. For example, the delivering section 64 controls operation of the delivery mechanism 6 in order to position an outer circumferential portion of the workpiece unit 11 in a position, i.e., a measuring position, between the upper surface measuring device 16 and the lower surface measuring device 18 of the measuring unit 12.

The measuring section 66 controls operation of the measuring unit 12 and the measuring unit 52. For example, the measuring section 66 controls operation of the measuring unit 12 in order to measure a distance, i.e., a first distance, between the upper surface of the workpiece unit 11 whose outer circumferential portion has been positioned in the measuring position and the upper surface measuring device 16 and also to measure a distance, i.e., a second distance, between the lower surface of this workpiece unit 11 and the lower surface measuring device 18.

The grinding section 68 controls operation of the turntable 24, the chuck tables 26, the grinding units 42, and components related to them. For example, the grinding section 68 controls operation of the turntable 24, the chuck tables 26, the grinding units 42, and the related components in order to grind the workpiece units 11 held on the respective chuck tables 26.

The deciding section 70 calculates a value of the thickness of the workpiece unit 11 on the basis of results of the measurement performed by the measuring unit 12. For example, the deciding section 70 calculates a value of the thickness of the workpiece unit 11 by subtracting the first distance and the second distance from the value of the interval, stored in the storage section 62, between the upper surface measuring device 16 and the lower surface measuring device 18 of the measuring unit 12.

Moreover, the deciding section 70 decides whether the workpiece unit 11 is a target to be ground or not on the basis of the value of the thickness of the workpiece unit 11 that is obtained from the results of the measurement performed by the measuring unit 12. For example, the deciding section 70 decides whether a desired tape 19 has been affixed to the workpiece 13 or not by comparing the sum of the values of the thicknesses, stored in the storage section 62, of the workpiece 13 and the tape 19 and the calculated value of the thickness of the workpiece unit 11 with each other.

If the deciding section 70 decides that a desired tape 19 has been affixed to the workpiece 13, then the deciding section 70 determines that the workpiece unit 11 is a target to be ground. If the deciding section 70 decides that a desired tape 19 has not been affixed to the workpiece 13, then the deciding section 70 determines that the workpiece unit 11 is not a target to be ground.

Figure 6:
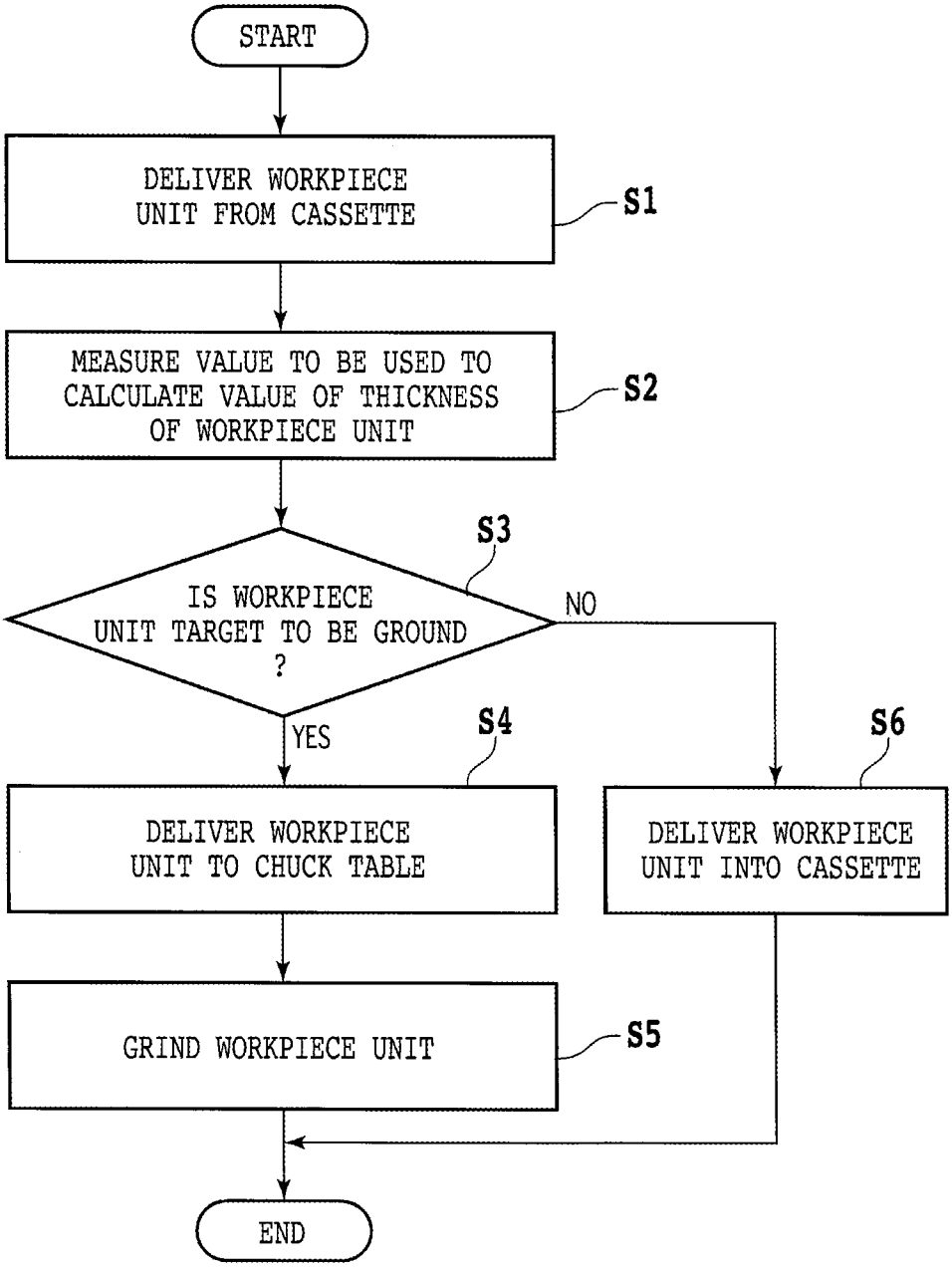
FIG. 6 is a flowchart of an example of a processing sequence of a method of driving the grinding apparatus.

FIG. 6 is a flowchart schematically illustrating an example of a processing sequence of a method of driving the grinding apparatus 2. According to the method of driving the grinding apparatus 2 as illustrated in FIG. 6, first, the delivery mechanism 6 delivers the workpiece unit 11 out of the cassette 8*a* placed on the cassette rest base 10*a* (unloading step: S1). Then, the delivery mechanism 6 positions the workpiece unit 11 in the measuring position referred to above.

Then, the measuring unit 12 measures values to be used to calculate a value of the thickness of the workpiece unit 11, i.e., the first distance and the second distance referred to above (measuring step: S2). Thereafter, the deciding section 70 of the control unit 58 calculates a value of the thickness of the workpiece unit 11, as described above.

Then, the deciding section 70 decides whether the workpiece unit 11 is a target to be ground or not on the basis of the value of the thickness of the workpiece unit (deciding step: S3). Specifically, the deciding section 70 decides whether the workpiece unit 11 is a target to be ground or not on the basis of whether a desired tape 19 has been affixed to the workpiece 13 or not, as described above.

If the deciding section 70 determines that the workpiece unit 11 is a target to be ground (S3: YES), then the workpiece unit 11 is delivered to the chuck table 26 (loading step: S4). Specifically, the delivery mechanism 6 delivers the workpiece unit 11 to the position adjusting mechanism 20, and the delivery mechanism 22 delivers the workpiece unit 11 that has been adjusted in position by the position adjusting mechanism 20 from the position adjusting mechanism 20, and then delivers the workpiece unit 11 to the chuck table 26.

When the workpiece unit 11 is delivered to and placed on the chuck table 26, the workpiece unit 11 is ground (grinding step: S5). If the deciding section 70 determines that the workpiece unit 11 is not a target to be ground (S3: NO), then the workpiece unit 11 is delivered back into the cassette 8*a* (loading step: S6).

According to the grinding apparatus 2 and the method of driving the grinding apparatus 2, as described above, a value of the thickness of the workpiece unit 11 can be recognized after the workpiece unit 11 has been delivered out of the cassette 8*a* and before the workpiece unit 11 is delivered to the chuck table 26, on the basis of the results of the measurement performed by the measuring unit 12. The value of the thickness of the workpiece unit 11 represents the sum of the values of the thicknesses of the workpiece 13 and the tape 19 affixed thereto.

Consequently, it is possible to decide whether the tape 19 affixed to the workpiece 13 has a desired thickness or not, i.e., is of a desire type or not, on the basis of the results of the measurement. Stated otherwise, it is possible to decide whether the workpiece unit 11 is a target to be ground or not before the workpiece unit 11 is delivered to the chuck table 26. As a result, a workpiece 13 with an inadequate tape 19 affixed thereto is prevented from being ground.

Figure 7:
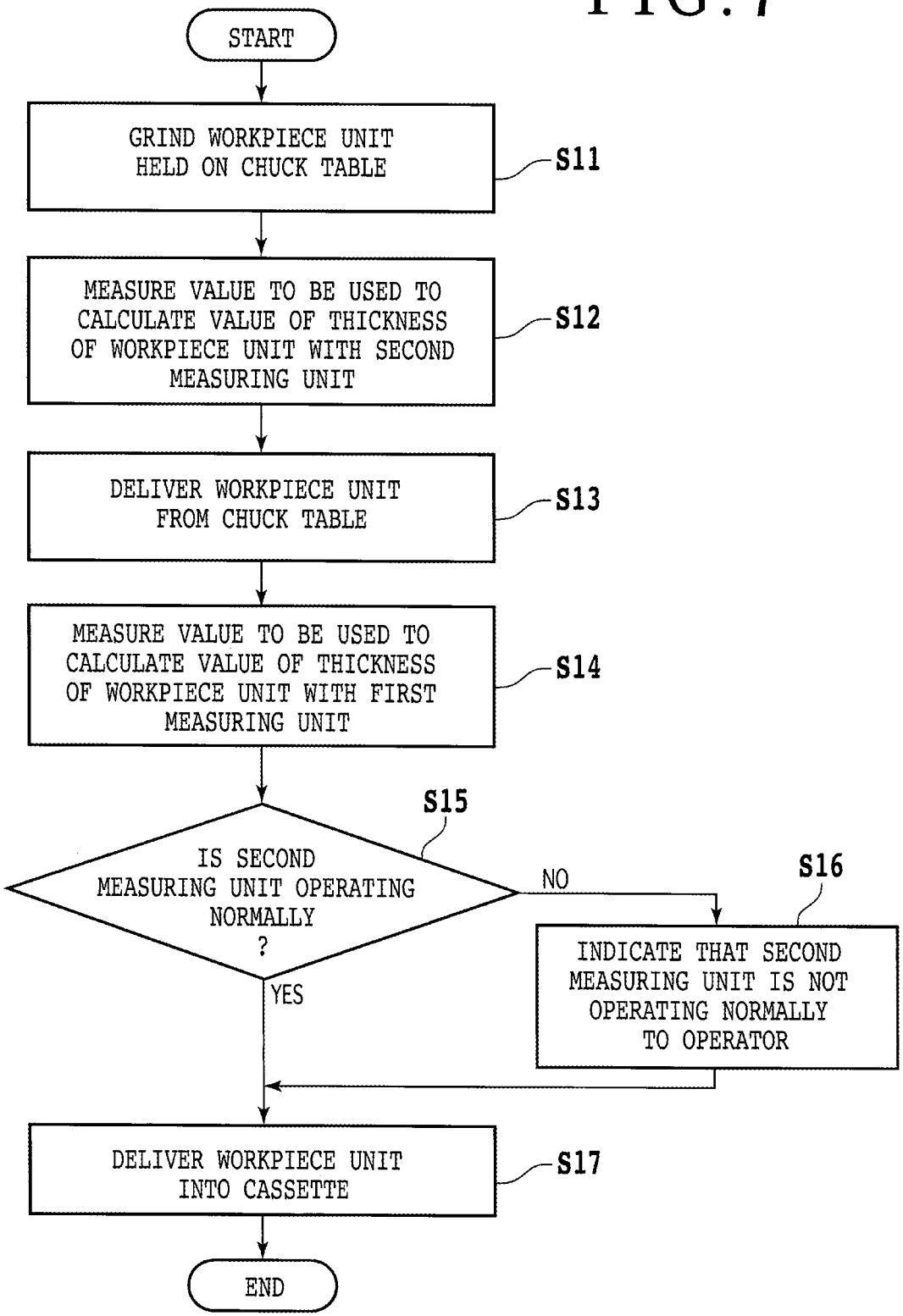
FIG. 7 is a flowchart of another example of the processing sequence of the method of driving the grinding apparatus.

Furthermore, in the grinding apparatus 2, it is possible to confirm whether the measuring unit, i.e., the second measuring unit, 52 is operating normally or not. FIG. 7 is a flowchart of an example of the processing sequence of the method of driving the grinding apparatus 2 for confirming whether the second measuring unit 52 is operating normally or not. According to the method of driving the grinding apparatus 2 as illustrated in FIG. 7, first, the workpiece unit 11 held on the chuck table 26 is ground (grinding step: S11).

Then, the measuring unit 52 measures values to be used to calculate a value of the thickness of the workpiece unit 11 held on the chuck table 26, i.e., the vertical position, i.e., the height, of the upper surface of the workpiece unit 11 and the vertical position, i.e., the height, of the holding surface 26*a* of the chuck table 26 (measuring step: S12).

Then, the deciding section 70 calculates a value of the thickness of the workpiece unit 11 on the basis of the results of the measurement performed by the measuring unit 52. Specifically, the deciding section 70 calculates the difference between the vertical position, i.e., the height, of the upper surface of the workpiece unit 11 and the vertical position, i.e., the height, of the holding surface 26*a* of the chuck table 26, as a value of the thickness of the workpiece unit 11.

The measuring unit 52 may measure the values continuously from a time before the workpiece unit 11 is ground to a time after the workpiece unit 11 has been ground. In such a case, the display as a component of the touch panel may be controlled to indicate the thickness of the workpiece unit 11 being ground to the operator at any time.

Then, the delivery mechanism 54 delivers the workpiece unit 11 from the chuck table 26 (unloading step: S13). Specifically, the delivery mechanism 54 delivers the workpiece unit 11 from the chuck table 26 to the cleaning unit 56, and the delivery mechanism 6 delivers the workpiece unit 11 cleaned by the cleaning unit 56 from the cleaning unit 56 into the measuring position referred to above.

Then, the measuring unit, i.e., the first measuring unit, 12 measures values to be used to calculate a value of the thickness of the workpiece unit 11, i.e., the first distance and the second distance referred to above (measuring step: S14). Thereafter, the deciding section 70 of the control unit 58 calculates a value of the thickness of the workpiece unit 11, as described above.

Then, the deciding section 70 decides whether the measuring unit 52 is operating normally or not by comparing the value of the thickness of the workpiece unit 11 obtained on the basis of the values of the measurement performed by the measuring unit 52 and the value of the thickness of the workpiece unit 11 obtained on the basis of the values of the measurement performed by the measuring unit 12 (deciding step: S15).

For example, if the compared values are equal to each other, then the deciding section 70 determines that the measuring unit 52 is operating normally, and if the compared values are different from each other, then the deciding section 70 determines that the measuring unit 52 is not operating normally. Alternatively, if the difference between the compared values is equal to or smaller than a predetermined threshold value, then the deciding section 70 may determine that the measuring unit 52 is operating normally, and if the difference between the compared values exceeds the predetermined threshold value, then the deciding section 70 may determine that the measuring unit 52 is not operating normally. The storage section 62 may store the threshold value in advance.

If the deciding section 70 determines that the measuring unit 52 is not operating normally (S15: NO), then that effect is indicated to the operator (indicating step: S16). For example, an error message, i.e., a message representing that the measuring unit 52 is not operating normally, is displayed on the display that is the component of the touch panel. Thereafter, the delivery mechanism 6 delivers the workpiece unit 11 into the cassette 8*b* placed on the cassette rest base 10*b* (loading step: S17).

On the other hand, if the deciding section 70 determines that the measuring unit 52 is operating normally (S15: YES), then no special processing is carried out, and the delivery mechanism 6 delivers the workpiece unit 11 into the cassette 8*b* placed on the cassette rest base 10*b* (loading step: S17).

Figure 8:
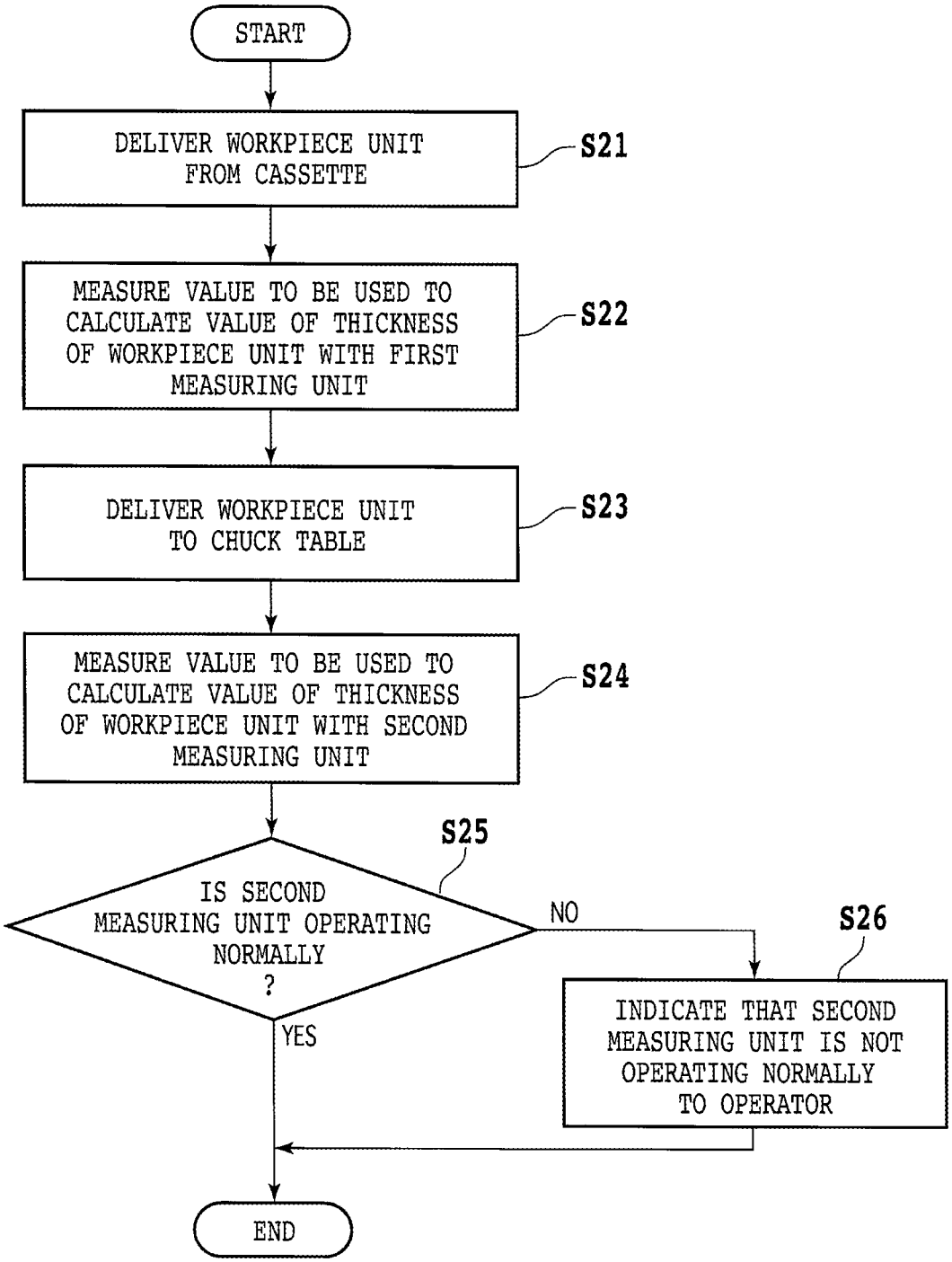
FIG. 8 is a flowchart of still another example of the processing sequence of the method of driving the grinding apparatus.

Moreover, in the grinding apparatus 2, it is also possible to confirm whether the measuring unit, i.e., the second measuring unit, 52 is operating normally or not prior to the grinding of the workpiece unit 11. FIG. 8 is a flowchart of an example of the processing sequence of the method of driving the grinding apparatus 2 for confirming whether the second measuring unit 52 is operating normally or not prior to the grinding of the workpiece unit 11. According to the method of driving the grinding apparatus 2 as illustrated in FIG. 8, first, the delivery mechanism 6 delivers the workpiece unit 11 out of the cassette 8*a* placed on the cassette rest base 10*a* (unloading step: S21).

Then, the measuring unit, i.e., the first measuring unit, 12 measures values to be used to calculate a value of the thickness of the workpiece unit 11, i.e., the first distance and the second distance referred to above (measuring step: S22). Thereafter, the deciding section 70 of the control unit 58 calculates a value of the thickness of the workpiece unit 11, as described above.

Then, the workpiece unit 11 is delivered to the chuck table 26 (loading step: S23). Specifically, the delivery mechanism 6 delivers the workpiece unit 11 to the position adjusting mechanism 20, and the delivery mechanism 22 delivers the workpiece unit 11 that has been adjusted in position by the position adjusting mechanism 20 from the position adjusting mechanism 20, and then delivers the workpiece unit 11 to the chuck table 26.

Then, the measuring unit, i.e., the second measuring unit, 52 measures values to be used to calculate a value of the thickness of the workpiece unit 11 held on the chuck table 26, i.e., the vertical position, i.e., the height, of the upper surface of the workpiece unit 11 and the vertical position, i.e., the height, of the holding surface 26*a* of the chuck table 26 (measuring step: S24).

Then, the deciding section 70 calculates a value of the thickness of the workpiece unit 11 on the basis of the results of the measurement performed by the measuring unit 52. Specifically, the deciding section 70 calculates the difference between the vertical position, i.e., the height, of the upper surface of the workpiece unit 11 and the vertical position, i.e., the height, of the holding surface 26*a* of the chuck table 26, as a value of the thickness of the workpiece unit 11.

Then, the deciding section 70 decides whether the measuring unit 52 is operating normally or not by comparing the value of the thickness of the workpiece unit 11 obtained on the basis of the values of the measurement performed by the measuring unit 52 and the value of the thickness of the workpiece unit 11 obtained on the basis of the values of the measurement performed by the measuring unit 12 (deciding step: S25).

For example, if the compared values are equal to each other, then the deciding section 70 determines that the measuring unit 52 is operating normally, and if the compared values are different from each other, then the deciding section 70 determines that the measuring unit 52 is not operating normally. Alternatively, if the difference between the compared values is equal to or smaller than a predetermined threshold value, then the deciding section 70 may determine that the measuring unit 52 is operating normally, and if the difference between the compared values is in excess of the predetermined threshold value, then the deciding section 70 may determine that the measuring unit 52 is not operating normally. The storage section 62 may store the threshold value in advance.

If the deciding section 70 determines that the measuring unit 52 is not operating normally (S25: NO), then that effect is indicated to the operator (indicating step: S26). For example, an error message, i.e., a message representing that the measuring unit 52 is not operating normally, is displayed on the display that is the component of the touch panel.

According to the examples of the processing sequence of the method of driving the grinding apparatus 2 as illustrated in FIGS. 7 and 8, it is confirmed whether the measuring unit 52 is operating normally or not by comparing the value of the thickness of the workpiece unit 11 obtained on the basis of the values of the measurement performed by the measuring unit, i.e., the second measuring unit, 52 and the value of the thickness of the workpiece unit 11 obtained on the basis of the values of the measurement performed by the measuring unit, i.e., the first measuring unit, 12.

Therefore, a failure or a malfunction of the measuring unit 52 can be found at an early stage. It is thus possible to find at an early stage problems such as a processing defect due to an excess or lack of grinding on the workpiece unit 11.

Furthermore, it is confirmed using the measuring unit, i.e., the first measuring unit, 12 whether the workpiece unit 11 is a target to be ground or not and whether the measuring unit, i.e., the second measuring unit, 52 is operating normally or not. Consequently, the grinding apparatus 2 is preferable in terms of configurational simplicity to a grinding apparatus having individual components respectively for confirming whether the workpiece unit 11 is a target to be ground or not and whether the measuring unit 52 is operating normally or not.

The grinding apparatus 2 merely represents an example of the grinding apparatus according to the present invention, and the grinding apparatus according to the present invention is not limited to the grinding apparatus 2. For example, the measuring unit 12 and the measuring unit 52 may be replaced with a measuring unit for directly measuring the thickness of the workpiece unit 11. Similarly, the measuring unit 12 may be replaced with a measuring unit for measuring a measurand while in contact therewith, and the measuring unit 52 may be replaced with a measuring unit for measuring a measurand while out of contact therewith, i.e., while not in contact therewith.

In addition, the method of driving the grinding apparatus 2 as illustrated in FIGS. 6 through 8 merely represents examples of the method of driving the grinding apparatus according to the present invention. The method of driving the grinding apparatus according to the present invention is not limited to either of the examples of the method of driving the grinding apparatus 2 as illustrated in FIGS. 6 through 8. For example, a method of driving the grinding apparatus which includes an any combination of the steps illustrated in FIGS. 6 through 8 also represents an example of the method of driving the grinding apparatus according to the present invention.

The structural details, method details, etc. according to the above embodiment and modifications can be changed or modified without departing from the scope of the present invention.

The present invention is not limited to the details of the above described preferred embodiment. The scope of the invention is defined by the appended claims and all changes and modifications as fall within the equivalence of the scope of the claims are therefore to be embraced by the invention.

What is claimed is:

1. A grinding apparatus comprising:

a cassette rest base for placing thereon a cassette for housing a workpiece unit that includes a workpiece and a tape affixed to a surface of the workpiece;

a chuck table for holding the workpiece unit thereon;

a delivery mechanism for delivering the workpiece unit between the cassette and the chuck table;

a first measuring unit for measuring a value of a thickness of the workpiece unit held by the delivery mechanism or a value to be used to calculate the value of the thickness of the workpiece unit held by the delivery mechanism, wherein the workpiece unit includes an upper surface and a lower surface opposite to the upper surface;

a grinding unit for grinding the workpiece unit held on the chuck table; and a control unit for controlling the chuck table, the delivery mechanism, the first measuring unit, and the grinding unit, wherein the control unit includes a deciding section for deciding whether the workpiece unit is a target to be ground or not depending on the value of the thickness of the workpiece unit that is obtained from a result of the measurement performed by the first measuring unit on the workpiece unit after the workpiece unit has been delivered from the cassette and before the workpiece unit is delivered to the chuck table, and wherein the control unit includes a storage section for storing values of respective thicknesses of the workpiece and the tape, the deciding section decides whether a desired tape has been affixed to the workpiece or not by comparing a sum of the values of the thicknesses, stored in the storage section, of the workpiece and the tape and the value of the thickness of the workpiece unit that is obtained from the result of the measurement performed by the first measuring unit with each other.

2. The grinding apparatus according to claim 1, wherein the first measuring unit includes:

a first non-contact-type distance measuring device disposed on a side of the upper surface of the workpiece unit held by the delivery mechanism, for measuring a distance up to the upper surface of the workpiece unit, and a second non-contact-type distance measuring device disposed on a side of the lower surface the workpiece unit held by the delivery mechanism, for measuring a distance up to the lower surface of the workpiece unit.

3. The grinding apparatus according to claim 2, further comprising:

a second measuring unit for measuring a value of the thickness of the workpiece unit held on the chuck table or a value to be used to calculate the value of the thickness of the workpiece unit held on the chuck table, wherein the deciding section decides whether the second measuring unit is operating normally or not by comparing the value of the thickness of the workpiece unit that is obtained from a result of the measurement performed by the second measuring unit and the value of the thickness of the workpiece unit that is obtained from the result of the measurement performed by the first measuring unit with each other.

4. The grinding apparatus according to claim 1, further comprising:

a second measuring unit for measuring a value of the thickness of the workpiece unit held on the chuck table or a value to be used to calculate the value of the thickness of the workpiece unit held on the chuck table, wherein the deciding section decides whether the second measuring unit is operating normally or not by comparing the value of the thickness of the workpiece unit that is obtained from a result of the measurement performed by the second measuring unit and the value of the thickness of the workpiece unit that is obtained from the result of the measurement performed by the first measuring unit with each other.

5. The grinding apparatus according to claim 1, wherein the workpiece unit is raised above a height of the chuck table when the value measured by the first measuring unit is obtained.

6. A method of driving a grinding apparatus including a cassette rest base for placing thereon a cassette for housing a workpiece unit that includes a workpiece and a tape affixed to a surface of the workpiece, a chuck table for holding the workpiece unit thereon, a delivery mechanism for delivering the workpiece unit between the cassette and the chuck table, a first measuring unit for measuring a value of a thickness of the workpiece unit held by the delivery mechanism or a value to be used to calculate the value of the thickness of the workpiece unit held by the delivery mechanism, a grinding unit for grinding the workpiece unit held on the chuck table, and a control unit for controlling the chuck table, the delivery mechanism, the first measuring unit, and the grinding unit, wherein the control unit includes a storage section for storing values of respective thicknesses of the workpiece and the tape, the method comprising:

a first unloading step in which the delivery mechanism delivers the workpiece unit from the cassette placed on the cassette rest base;

a first measuring step in which the first measuring unit measures a value of the thickness of the workpiece unit held by the delivery mechanism or a value to be used to calculate the value of the thickness of the workpiece unit held by the delivery mechanism, wherein the workpiece unit includes an upper surface and a lower surface opposite to the upper surface;

a first deciding step in which the control unit decides whether the workpiece unit is a target to be ground or not depending on the value of the thickness of the workpiece unit that is obtained from a result of the measurement performed in the first measuring step, wherein in the first deciding step, the control unit decides whether a desired tape has been affixed to the workpiece or not by comparing a sum of the values of the thicknesses, stored in the storage section, of the workpiece and the tape and the value of the thickness of the workpiece unit that is obtained from the result of the measurement performed in the first measuring step with each other; and a loading step in which, if the control unit determines in the first deciding step that the workpiece unit is a target to be ground, then the delivery mechanism delivers the workpiece unit to the chuck table, and if the control unit determines in the first deciding step that the workpiece unit is not a target to be ground, then the delivery mechanism delivers the workpiece unit back into the cassette.

7. The method of driving the grinding apparatus according to claim 6, the grinding apparatus further including:

a second measuring unit for measuring a value of the thickness of the workpiece unit held on the chuck table or a value to be used to calculate the value of the thickness of the workpiece unit held on the chuck table, the method further comprising:

a grinding step in which the grinding unit grinds the workpiece unit delivered to the chuck table in the loading step;

a second measuring step in which the second measuring unit measures a value of the thickness of the workpiece unit ground in the grinding step or a value to be used to calculate the value of the thickness of the workpiece unit ground in the grinding step;

a second unloading step in which the delivery mechanism delivers the workpiece unit whose value of the thickness has been measured in the second measuring step from the chuck table;

a third measuring step in which the first measuring unit measures a value of the thickness of the workpiece unit delivered from the chuck table in the second unloading step or a value to be used to calculate the value of the thickness of the workpiece unit delivered from the chuck table in the second unloading step; and a second deciding step in which the control unit decides whether the second measuring unit is operating normally or not by comparing the value of the thickness of the workpiece unit that is obtained from a result of the measurement performed in the second measuring step and the value of the thickness of the workpiece unit that is obtained from a result of the measurement performed in the third measuring step with each other.

8. The method of driving the grinding apparatus according to claim 6, the grinding apparatus further including:

a second measuring unit for measuring a value of the thickness of the workpiece unit held on the chuck table or a value to be used to calculate the value of the thickness of the workpiece unit held on the chuck table, the method further comprising:

a second measuring step in which the second measuring unit measures a value of the thickness of the workpiece unit before the workpiece unit delivered to the chuck table in the loading step is ground or a value to be used to calculate the value of the thickness of the workpiece unit before the workpiece unit delivered to the chuck table in the loading step is ground; and a second deciding step in which the control unit decides whether the second measuring unit is operating normally or not by comparing the value of the thickness of the workpiece unit that is obtained from a result of the measurement performed in the second measuring step and the value of the thickness of the workpiece unit that is obtained from a result of the measurement performed in the first measuring step with each other.

9. The method of driving the grinding apparatus according to claim 6, wherein the workpiece unit is raised above a height of the chuck table when the value measured by the first measuring unit is obtained.

10. A grinding apparatus comprising:

a cassette rest base for placing thereon a cassette for housing a workpiece unit that includes a workpiece and a tape affixed to a surface of the workpiece;

a chuck table for holding the workpiece unit thereon;

a delivery mechanism for delivering the workpiece unit between the cassette and the chuck table;

a first measuring unit for measuring a value of a thickness of the workpiece unit held by the delivery mechanism or a value to be used to calculate the value of the thickness of the workpiece unit held by the delivery mechanism;

a second measuring unit for measuring a value of the thickness of the workpiece unit held on the chuck table or a value to be used to calculate the value of the thickness of the workpiece unit held on the chuck table;

a grinding unit for grinding the workpiece unit held on the chuck table; and a control unit for controlling the chuck table, the delivery mechanism, the first measuring unit, and the grinding unit, wherein the control unit includes a deciding section for deciding whether the workpiece unit is a target to be ground or not depending on the value of the thickness of the workpiece unit that is obtained from a result of the measurement performed by the first measuring unit on the workpiece unit after the workpiece unit has been delivered from the cassette and before the workpiece unit is delivered to the chuck table, wherein the deciding section decides whether the second measuring unit is operating normally or not by comparing the value of the thickness of the workpiece unit that is obtained from a result of the measurement performed by the second measuring unit and the value of the thickness of the workpiece unit that is obtained from the result of the measurement performed by the first measuring unit with each other.

11. The grinding apparatus according to claim 10, wherein the control unit includes a storage section for storing values of respective thicknesses of the workpiece and the tape, the deciding section decides whether a desired tape has been affixed to the workpiece or not by comparing a sum of the values of the thicknesses, stored in the storage section, of the workpiece and the tape and the value of the thickness of the workpiece unit that is obtained from the result of the measurement performed by the first measuring unit with each other.

12. The grinding apparatus according to claim 10, wherein the first measuring unit includes:

a first non-contact-type distance measuring device disposed on a side of one surface of the workpiece unit held by the delivery mechanism, for measuring a distance up to the one surface of the workpiece unit, and a second non-contact-type distance measuring device disposed on a side of another surface that is a reverse surface opposite the one surface of the workpiece unit held by the delivery mechanism, for measuring a distance up to the other surface of the workpiece unit.

* * * * *